US006460979B1

(12) United States Patent
Heinzl et al.

(10) Patent No.: US 6,460,979 B1
(45) Date of Patent: Oct. 8, 2002

(54) PIEZO BENDING TRANSDUCER DROP-ON DEMAND PRINT HEAD AND METHOD OF ACTUATING IT

(75) Inventors: Joachim Heinzl; Ingo Ederer, both of München; Hermann Seitz, Legau, all of (DE)

(73) Assignee: Tally Computerdrucker GmbH, Ulm-Elchingen (DE)

( * ) Notice: Subject to any disclaimer, the term of this patent is extended or adjusted under 35 U.S.C. 154(b) by 0 days.

(21) Appl. No.: 09/525,438

(22) Filed: Mar. 14, 2000

(30) Foreign Application Priority Data

Mar. 15, 1999 (DE) ..... 199 11 399

(51) Int. Cl.[7] ..... B41J 2/045; B41J 2/05
(52) U.S. Cl. ..... 347/68; 347/57
(58) Field of Search ..... 347/68, 70, 75, 347/57, 10

(56) References Cited

U.S. PATENT DOCUMENTS 5,831,650 A * 11/1998 Reinten ..... 347/68
6,239,821 B1 * 5/2001 Silverbrook ..... 347/54

FOREIGN PATENT DOCUMENTS

DE 25 27 647 12/1976
DE 31 14 259 11/1982
DE 691 19 088 8/1996
EP 713 773 A2 8/1996

OTHER PUBLICATIONS

Patent Abstracts of Japan, M–924, Jan. 24, 1990, vol. 14/No. 39 JP–63–101758.

* cited by examiner

*Primary Examiner*—Thinh Nguyen
(74) *Attorney, Agent, or Firm*—Cohen, Pontani, Lieberman & Pavane

(57) ABSTRACT

Disclosed is a piezo bending transducer drop-on-demand print head and a method of actuating it. Each of the piezo bending transducers of a piezo bending transducer drop-on-demand print head is subjected to a sequence, corresponding to the desired print image, of triggering pulses each effecting a drop discharge movement and, assigned to each triggering pulse, each piezo bending transducer neighboring the piezo bending transducer triggered by the triggering pulse is subjected to a compensating pulse deflecting it. The piezo bending transducer drop-on-demand print head has a nozzle plate with nozzles arranged in series. Respectively assigned to each nozzle is a piezo bending transducer which can be subjected to a triggering pulse accompanied by a drop being discharged from the respective nozzle. There is a control device by which each of the piezo bending transducers can be subjected to triggering pulses and compensating pulses in accordance with the method of the invention.

42 Claims, 10 Drawing Sheets

PIEZO BENDING TRANSDUCER DROP-ON DEMAND PRINT HEAD AND METHOD OF ACTUATING IT

BACKGROUND OF THE INVENTION

1. Field of the Invention

The invention is in a drop-on-demand print head having a drop generator with nozzles arranged in series, respectively assigned to which there is a piezoelectric bending transducer for discharging sequences of drops and also is in a method of actuating a piezo bending transducer drop-on-demand print head.

2. Description of the Related Art

A customary piezo bending transducer drop-on-demand print head is disclosed in DE 25 27 647 C3. A series of nozzles extending perpendicularly to the plane of a nozzle plate is provided in a plate of a head. Oriented parallel to the nozzle plate are piezo bending transducers in the form of an extending reed which is restrained at one end, so-called piezo reed transducers, arranged in a series adjacent and parallel to one another in such a way that their non-restrained ends are respectively opposite one of the nozzles. Each of the piezo bending transducers is designed as a piezo bimorph, which has a bending axis extending parallel to the nozzle plate and perpendicularly to the nozzles. For discharging a drop, the piezo reed is bent by applying a voltage, so that the free end moves away from the assigned nozzle. The voltage is switched off and the free end races toward the nozzle and forces a quantity of fluid through the nozzle, so that a drop is discharged.

In a construction of this type, the nozzles must be arranged very closely together to produce a print with a high resolution, i.e. large number of dots per unit length. The piezo bending transducers must, to the extent possible, cover the entire assigned nozzle with their width to achieve a clean drop discharge. If the nozzles are closely arranged, the mutually neighboring piezo bending transducers therefore likewise lie very closely together, as do the respectively assigned nozzles. The actuation of a piezo bending transducer consequently also results in "crosstalk"—a fluid flow through the nozzles assigned to the neighboring piezo bending transducers. As a result, a proportion of the flow energy generated is not imparted to the drop to be printed. Furthermore, it may happen that a drop is discharged from the neighboring nozzle, which results in a falsification of the desired print image.

DE 31 14 259 A1 discloses a special design of the nozzles to eliminate the problem of crosstalk. The nozzles have, on the side of the nozzle plate facing away from the piezo bending transducers, a circular cross section with a diameter dependent on the desired drop shape. Toward the side facing the piezo bending transducers, the nozzle widens in a funnel-shaped manner, although not rotationally symmetrically but only in the direction parallel to the piezo bending transducers. In the direction perpendicular to the piezo bending transducers, the nozzle has a constant width, so that the nozzles can be arranged closely together.

However, the production of such nozzles requires high expenditure. Furthermore, the crosstalk reduction with these nozzles, while significant, is still not adequate, particularly in the case of print heads with high resolutions.

EP 0 713 773(Heinzl, Schullerus) proposes that partitions be provided between the individual piezo bending transducers. Although this leads to a complete elimination of crosstalk, it requires a substantial expenditure in production and assembly. Since a very small distance between neighboring nozzles or piezo bending transducers is always desired for the purpose of increasing the printing resolution, the partitions must be produced and positioned in such a way as to maintain extreme tolerances. Furthermore, the fluid friction in the narrow gaps between piezo bending transducers and partitions leads to considerable losses in the speed of the transducer movement and in the energy of the discharged drop.

SUMMARY OF THE INVENTION

The present invention is in a piezo bending transducer drop-on-demand print head with high resolution which can be produced with low production and assembly expenditure and operates without crosstalk.

The object is achieved according to the invention by a method of actuating a piezo bending transducer drop-on-demand print head with a nozzle plate with nozzles arranged in series, respectively assigned to which there is a piezo bending transducer, each of the piezo bending transducers being subjected to a sequence, corresponding to the desired print image, of triggering pulses each effecting a drop discharge movement. Assigned to each triggering pulse, each piezo bending transducer neighboring the piezo bending transducer triggered by the triggering pulse is subjected to a compensating pulse to deflect it.

The deflection of the neighboring piezo bending transducer by the compensating pulse effects a fluid movement locally at the nozzle assigned to the neighboring piezo bending transducer. This fluid movement acts counter to the fluid movement which is caused by the triggering pulse and the movement of the triggered piezo bending transducer directly at the nozzle assigned to the neighboring piezo bending transducer. The fluid movements fully or partly compensate for one another. No drop discharge occurs at the nozzle assigned to the neighboring piezo bending transducer (neighboring nozzle). Falsification of the print image is prevented. The disadvantageous effects of crosstalk are consequently eliminated.

No partitions between mutually neighboring piezo bending transducers or special nozzle shapes are required. The nozzle plate and the wall of the printer chamber can be of a simple design. Production and assembly costs are consequently kept low.

Furthermore, mutually neighboring piezo bending transducers can be arranged as closely together as the nozzle width allows. Therefore, a print head with a very high resolution is obtained.

The narrow gaps between the piezo bending transducer and the conventionally provided partitions are no longer needed. During a return or restoring movement of the piezo bending transducer, the flow of additional printing fluid laterally past the piezo bending transducer occurs more quickly. A subsequent drop discharge is consequently possible at a shorter time interval from the preceding discharge thus enabling an increase in the printing frequency.

According to the invention, the piezo bending transducers can be subjected to discharging pulses which bring about a deflection of the piezo bending transducer toward the assigned nozzle. However, the piezo bending transducers are preferably subjected to triggering pulses which cause a deflection of the piezo bending transducer away from the assigned nozzle. The actual drop discharge movement of the piezo bending transducer then comprises racing back of the piezo structure on account of the mechanical stress built up during the application of the triggering pulse and the associated deflection. Such a racing back movement is generally faster than the deflecting movement.

Each of the neighboring piezo bending transducers is preferably subjected to a compensating pulse of a lower amplitude than that of the triggering pulse. This achieves the effect that a drop discharge is not stopped at the neighboring nozzle on account of the compensating pulse itself, either during the deflecting movement or during the racing-back movement of the neighboring piezo bending transducer. Furthermore, the energy extracted from the fluid movement is not so large that a drop discharge no longer occurs at the nozzle assigned to the triggered piezo bending transducer. Preferably, the applied compensating pulse has an amplitude of 10 to 40%, and more preferably, one third of the amplitude of the triggering pulse.

The neighboring piezo bending transducers are preferably subjected to a compensating pulse of a shorter duration in comparison with the duration of the triggering pulse. With a shorter pulse duration, as with a lower amplitude of the applied voltage, it is possible to achieve the effect that the deflection amplitude of the piezo bending transducer is lower in the case of the compensating pulse than in the case of the triggering pulse. Consequently, undesired drop discharge from the neighboring nozzle and undesirably high fluid-mechanical energy extraction are avoided. In comparison with the lower amplitude, the shorter pulse duration has the advantage that, both in the case of the triggering pulses and in the case of the compensating pulses, the piezo bending transducer can be operated with one and the same voltage, for which the piezo bending transducer is designed. A shorter pulse duration can also be realized very simply in terms of control technology.

The neighboring piezo bending transducers are preferably each subjected to a compensating pulse with a time delay after the assigned triggering pulse. Consequently, the fluid movement on account of the triggering pulse and the fluid movement on account of the compensating pulse largely overlap in time and compensate for one another particularly well. A time delay of 60 to 100 microseconds is preferred and a delay of 80 microseconds is particularly preferred.

In one embodiment of the invention, a compensating pulse is applied which deflects the neighboring piezo bending transducer in the opposite direction from that of the triggered piezo bending transducer. For this purpose, either a compensating pulse of a polarity opposite to that of the triggering pulse is applied, or the respectively other active position of a bimorph or trimorph is activated. If the triggered piezo bending transducer is initially moved away from the nozzle assigned to it and then races back, this means that the neighboring piezo bending transducer is initially deflected toward the nozzle assigned to it. The actually compensating fluid movement is then triggered by the rapid return of the neighboring piezo bending transducer.

According to another embodiment of the invention, the neighboring piezo bending transducer is subjected to a compensating pulse by which the neighboring piezo bending transducer is deflected in the same direction as the triggered piezo bending transducer. This can be achieved by subjecting the neighboring piezo bending transducer to a compensating pulse of the same polarity as that of the triggering pulse. If the triggered piezo bending transducer is initially moved away from the nozzle assigned to it and then races back, the neighboring piezo bending transducer is thus also initially deflected away from the nozzle assigned to it.

According to the invention it is possible that, irrespective of how many piezo bending transducers are triggered simultaneously and how they are arranged, only one type of compensating pulse is provided. However, if they are neighboring two triggered piezo bending transducers, the piezo bending transducers neighboring the triggered piezo bending transducers are preferably subjected to a compensating pulse of a stronger amplitude than if they are neighboring only one triggered piezo bending transducer. This ensures that there is adequate compensation for the fluid movement effected by the triggering pulse in every triggering setup.

According to the invention it is possible for the piezo bending transducers to be subjected to triggering pulses in three groups at staggered time intervals, every third piezo bending transducer in the series of piezo bending transducers respectively belonging to the same group.

According to a preferred embodiment of the invention, the piezo bending transducers are subjected to triggering pulses in two groups at staggered time intervals, mutually neighboring piezo bending transducers respectively belonging to different groups. In this way, the printing speed is increased. By providing two different intensities of compensating pulses, optimum compensation can be ensured in this embodiment as well.

According to another preferred embodiment of the invention, the piezo bending transducers are subjected to triggering pulses in a single group and the triggered piezo bending transducers are subjected to different triggering pulses, depending on whether both, one or none of the neighboring piezo bending transducers is/are likewise triggered. In this way, the printing speed can be increased still further. The triggering pulses of different intensity ensure that, even when there is simultaneous triggering of mutually neighboring piezo bending transducers, a uniform drop discharge from all the nozzles is achieved.

For example, in this embodiment the piezo bending transducers are subjected to a triggering pulse of lower amplitude when one of the respectively neighboring piezo bending transducers is likewise triggered than if none of the respectively neighboring piezo bending transducers is likewise triggered, and are subjected to a triggering pulse of still lower amplitude if both the respectively neighboring piezo bending transducers are likewise triggered.

According to the invention it is possible for the compensating pulses to be provided as square-wave signals. However, the neighboring piezo bending transducers are preferably subjected to compensating pulses with a gradually falling edge. This achieves the effect that, on account of the movement of the neighboring piezo bending transducers toward the neighboring nozzle, i.e., depending on the polarity, either during the deflection on account of the compensating pulse or during the rapid return after application of the compensating pulse, no drop discharge occurs at the neighboring nozzle, but instead a gradual dying down of the flow movement is achieved.

An alternative embodiment of the invention proposes a method of actuating a piezo bending transducer drop-on-demand print head with a nozzle plate with nozzles arranged in series, respectively assigned to which there is a piezo bending transducer, each of the piezo bending transducers being subjected to a sequence, corresponding to the desired print image, of triggering pulses each effecting a drop discharge movement, and, assigned to each triggering pulse, each piezo bending transducer neighboring the piezo bending transducer subjected to said pulse being subjected to a closing control pulse, by which the piezo bending transducer is deflected toward the assigned nozzle and is held there for a period during the drop discharge.

The deflection of the neighboring piezo bending transducers and securing of them at the nozzles assigned to them ensures that the nozzles are fully or partly screened flow-mechanically from the print head chamber filled with printing fluid. As a consequence, no drop can emerge from these nozzles. Falsification of the print image is prevented.

The neighboring piezo bending transducers are preferably subjected to the closing control pulse at a time prior to, or simultaneous with, the assigned triggering pulse. In this way it is ensured that the screening has already occurred when the drop-discharging movement of the piezo bending transducer subjected to the triggering pulse commences.

According to the invention, the neighboring piezo bending transducers may be subjected to a closing control pulse of an amplitude which comes close to that of a triggering pulse. The transducers are preferably subjected to a closing control pulse of an amplitude which is at most one sixth of the amplitude of the triggering pulse. This makes possible the use of piezo bending transducers of a two-pole type of design, i.e. a piezo bimorph with a passive layer or a monomorph. Since the triggering pulse usually deflects the piezo bending transducer away from the nozzle, the triggering pulse and the closing control pulse are opposed to each other. However, two-pole piezo bending transducers can actually be deflected only in one direction, namely their preferential direction. At low amplitude, however, a deflection counter to the preferential direction is also possible in the case of two-pole piezo bending transducers.

In the embodiment of the method according to the invention with compensating pulses and in the alternative embodiment with closing control pulses, it is preferred to conduct a trimming process prior to, or during, initial operation of the piezo bending transducer drop-on-demand print head. In other words, prior to placing the piezo bending transducers into operation, the amplitude, duration and/or time delay of compensating pulses or closing control pulses are determined for each of them by a trimming process in which the respectively applied compensating pulses or closing control pulses are varied with regard to amplitude, duration and/or time delay for intended setups of triggering pulses and are optimized by measuring the drop discharge and crosstalk behavior. In this way allowance can be made for manufacturing inaccuracies or inhomogeneities of the piezoceramic. The compensating pulse is adapted individually to the individual piezo bending transducer. In this way, a uniform drop discharge can be ensured at all the nozzles or piezo bending transducers even when there are manufacturing inaccuracies. If the trimming process is carried out not only with individual triggering pulses but with pulse combinations, i.e. simultaneous triggering of a plurality of piezo bending transducers in different setups, allowance can also be made for interactions between manufacturing or material inaccuracies of a plurality of piezo bending transducers.

In the trimming process, preferably only the duration and/or time delay of compensating pulses or closing control pulses are varied. This permits the trimming process to be conducted with low expenditure. Furthermore, the piezo bending transducers can be operated exclusively at the voltage amplitudes for which they are designed.

According to the invention, the measurements in the course of the trimming process can be carried out with a device that is independent of the piezo bending transducers. The piezo bending transducers are preferably used as sensors in the trimming process, where voltages are evaluated due to the triggering of a piezo bending transducer, the fluid movement brought about as a result and the deflecting of the neighboring piezo bending transducers are caused to be induced in the latter are measured and evaluated for optimizing the drop discharge or crosstalk behavior. As a result the crosstalk behavior can be determined without any additional expenditure on equipment and is thus inexpensive. Because effects in the print head itself are recorded, a particularly precise determination of the crosstalk behavior can be achieved.

The piezo bending transducers neighboring the triggered piezo bending transducers are preferably subjected during operation in progress to compensating pulses or closing control pulses for which the amplitude, duration and/or time delay have been determined, in that voltages which cause the triggering of a piezo bending transducer, the fluid movement brought about as a result and the deflecting of the neighboring piezo bending transducers caused to be induced in the latter are measured and processed. Thus, after a triggering pulse is applied, a neighboring piezo bending transducer initially serves as a sensor. The data recorded are evaluated and the amplitude, duration and/or time delay of the optimum compensating pulse are determined. The neighboring piezo bending transducer then serves as an actuator and the corresponding compensating pulse is applied to the neighboring piezo bending transducer with the determined time delay after the triggering pulse. In the evaluation, interactions between the data recorded at a plurality of piezo bending transducers can be taken into account. It can likewise be taken into account which piezo bending transducers are simultaneously actuated.

Such trimming of the pulses during operation makes it possible by adaptation of the pulses to compensate not only for the irregularities of the drop discharge brought about by manufacturing and material inaccuracies but also for irregularities of the drop discharge due to other reasons. For example, allowance can be made for differences in temperature conditions, for irregularities of the initial flow-mechanical conditions at the beginning of the triggering pulse, i.e. a residual flow owing to the preceding drop discharge, to compensate for vibrations. The trimming of the pulses, integrated into operation, consequently leads to a considerable improvement in the printed result, in particular to the printed result being largely independent of external influences.

According to the invention, ongoing trimming during operation of the piezo bending transducer drop-on-demand print head may be performed instead of, or in addition to, the pre-operation trimming.

The object is further achieved according to the invention by a piezo bending transducer drop-on-demand print head having a nozzle plate with nozzles arranged in series, respectively assigned to which there is a piezo bending transducer which can be subjected to a triggering pulse accompanied by a drop being discharged from the respective nozzle, and having a control device by which each of the piezo bending transducers can be subjected to triggering pulses and compensating pulses in accordance with one of the above described methods of the invention.

According to the invention, for the control device can be designed in a suitable way, for example as a computer with corresponding control software. The control device is preferably designed as an integrated circuit.

The piezo bending transducers may be designed for example as extending piezo strips which are restrained at both ends (piezo bridge transducers). The piezo bending transducers are preferably designed as extending reeds which are restrained at one end (piezo reed transducers). More preferably, the nozzles assigned to the piezo reed transducers are arranged in the region of the free ends of the piezo reed transducers.

The piezo bending transducers may be designed according to the invention as monomorphs, as bimorphs each with a passive layer, as bimorphs with two active layers or as trimorphs. Furthermore, they may be designed to utilize the longitudinal effect of the piezoceramic or the transverse effect of the piezoceramic. They may be constructed as single-layer transducers or as multi-layer transducers.

The piezo bending transducers are preferably designed as bimorphs with two active layers or as trimorphs, and the control device is preferably designed in such a way that the neighboring piezo bending transducers are deflected in the opposite direction to that of the triggered piezo bending transducer, in that the respectively other active layer of the piezo transducer is subjected to the compensating pulse. This eliminates the risk of the piezo bending transducer being destroyed which may occur if the deflection of the neighboring piezo bending transducer in the opposite direction were to take place by applying an oppositely polarized voltage to the same layer of a monomorph. Counter to the direction of polarity, a piezoceramic can only be subjected to about 10% of the maximum voltage.

According to the invention, the nozzles may be arranged, for example, in such a way that the nozzle axis extends parallel to the longitudinal direction of the piezo bending transducer and the nozzle is arranged in the extension of the piezo bending transducer (edge shooter). Alternatively, the nozzles may also be arranged, for example, in such a way that the nozzle axis extends perpendicularly to the longitudinal direction of the piezo bending transducer and perpendicularly to its bending axis and the nozzle is arranged in the region of the free end of the piezo bending transducer (side shooter).

The invention also includes an embodiment wherein a piezo bending transducer drop-on-demand print head having a nozzle plate with nozzles arranged in series, respectively assigned to which there is a piezo bending transducer which is subjected to a triggering pulse accompanied by a drop being discharged from the respective nozzle, and having a control device by which each of the piezo bending transducers is subjected to triggering pulses and closing control pulses in accordance with one of the methods according to the alternative embodiment of the invention.

The types of design of piezo bending transducers and control device described above can be used in this embodiment as well.

In this case, the piezo bending transducer drop-on-demand print head preferably has at least three-pole piezo bending transducers, each with two piezoceramic layers, and the triggering pulses are applied by the control device to the one piezoceramic layer and the closing control pulses are applied by the control device to the other piezoceramic layer of the piezo bending transducer. In this way, the closing control pulse can also have a greater amplitude without the risk of the piezo bending transducer being destroyed, as would be the case with a monomorph.

It is also within the invention to provide patterns of pulses in which not only the piezo bending transducer directly neighboring a triggered piezo bending transducer but also the next-but-one or next-but-two piezo bending transducers are subjected to compensating pulses, closing control pulses or modified triggering pulses.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF THE PRESENTLY PREFERRED EMBODIMENTS

The principle of the method according to the invention is shown in FIGS. 1*a* to 1*e*. Each of the figures schematically shows a detail of a piezo bending transducer drop-on-demand print head. As shown, in a nozzle plate 1 has three nozzles 11 in series, extending perpendicularly to the plane of the plate. Parallel to the nozzle plate 1, three piezo bending transducers 2 are arranged in a series parallel next to one another in such a way that their non-restrained ends 21 are respectively opposite one of the nozzles 11. Each of the piezo bending transducers 2 can be bent about a bending axis extending parallel to the nozzle plate 1 and perpendicularly to the nozzles 11.

FIGS. 1*a* to 1*e* show the position of the three piezo bending transducers 2 in different stages of the sequence of movements which takes place by the middle of the three piezo bending transducers 2 being subjected to a triggering pulse.

Figure 1A:
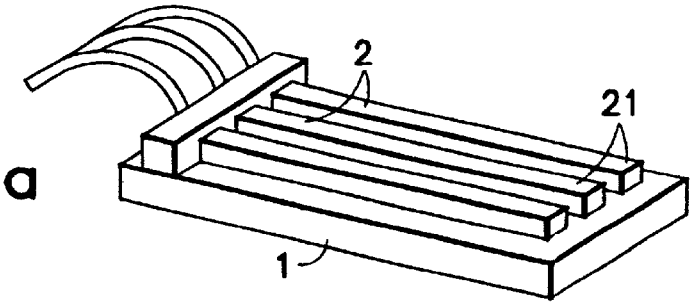
FIGS. 1*a* to 1*e* schematically show the mode of operation of a piezo bending transducer drop-on-demand print head actuated by the method of the invention and of a piezo bending transducer drop-on-demand print head according to the invention, respectively.
Figure 1B:
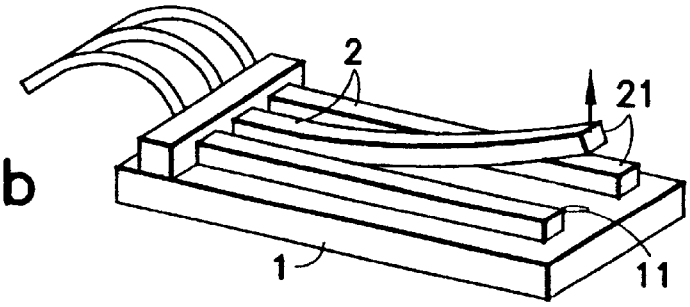

In FIG. 1*a*, all three piezo bending transducers 2 are in the position of rest. In FIG. 1*b*, the middle piezo bending transducer 2 is in the deflecting movement, as a result of the application of the triggering pulse, so that its free end 21 is being moved away from the assigned nozzle 11 (cf. arrow).

Figure 1C:
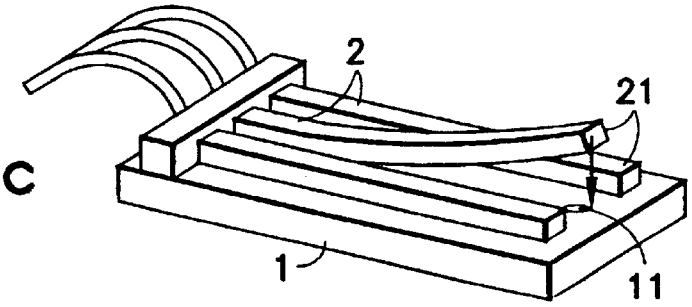

In FIG. 1*c*, the triggering pulse has terminated, the deflecting voltage is no longer acting, and the middle piezo bending transducer 2 is racing back as a result of the mechanical stresses built up in the structure during deflecting, so that the free end 21 is being moved toward the assigned nozzle 11 (cf. arrow).

Figure 1D:
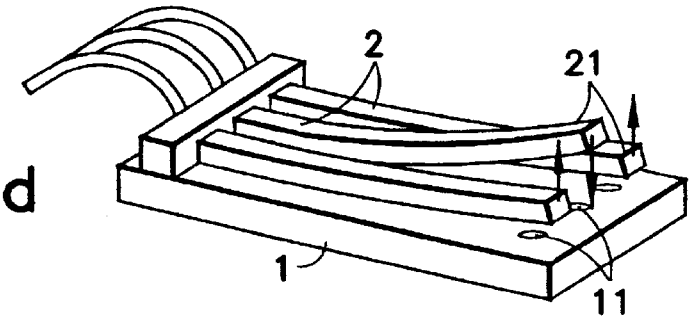

In FIG. 1*d*, the two outer piezo bending transducers 2 are being subjected to the compensating pulse and are consequently being deflected, so that their free ends 21 are bent away from the respectively assigned nozzles 11 (cf. arrows), while the middle piezo bending transducer 2 is continuing to race back as a result of the mechanical stresses, so that its free end 21 is being moved toward the assigned nozzle 11 (cf. arrow). The fluid displaced by the middle piezo bending transducer 2 toward the nozzles 11 assigned to the outer piezo bending transducers 2 is sucked away from the assigned nozzles 11 as a result of the deflecting movements of the outer piezo bending transducers 2 and is not discharged from the nozzles 11. Therefore, there is no falsification of the print image.

Figure 1E:
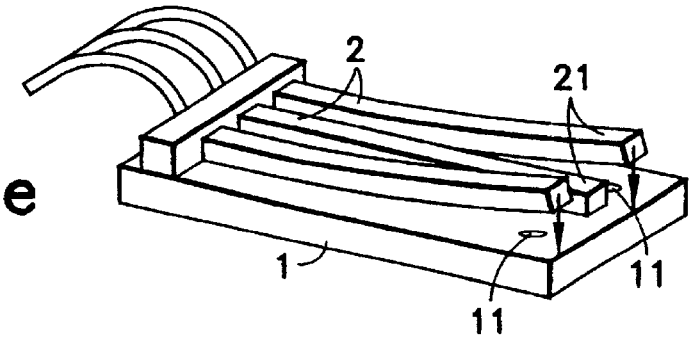

In FIG. 1*e*, the compensating pulses have also terminated, or are in a dying-down phase, and the outer piezo bending transducers 2 are racing back as a result of the mechanical stresses, so that their free ends 21 are being moved toward the assigned nozzles 11 (cf. arrow). As a result of the lower amplitude of the compensating pulses, or a suitable dying-down edge, the racing-back movement of the outer piezo bending transducers 2 does not lead to the surface tension at the assigned nozzles 11 being overcome and consequently does not lead to the exiting of a drop.

Actual exemplary embodiments are described.

A print head with actuators made of piezoceramic from the company PI Ceramic, Lederhose, is used. A piezo bending transducer has a length of 5 mm, a height of 0.32 mm and a width of 0.4 mm. The free length is 3.2 mm. The nozzle plate is made of silicon and has a thickness of 400 $\mu$m. The nozzle diameter is 60 $\mu$m. The nozzle channel length is 318 $\mu$m. The distance between the bar, i.e. the piezo bending transducer in the position of rest, and the nozzle plate is 20 $\mu$m. Diethyl succinate is used as a test medium for misprinting.

According to one embodiment, the actuation operates with the following pulses:

- triggering pulse: pulse width 50 $\mu$s, square-wave pulse, amplitude 55 V;
- compensating pulse: pulse width 17 $\mu$s, square-wave pulse, amplitude 55 V, time delay with respect to the triggering pulse: 67 $\mu$s.

According to another embodiment, the actuation operates with the following pulses:

- triggering pulse: pulse width 50 $\mu$s, square-wave pulse, amplitude 55 V;
- compensating pulse: pulse width 7 $\mu$s, square-wave pulse, amplitude 55 V, time delay with respect to the triggering pulse: 64 $\mu$s.

The principle of the method of the invention according to an alternative embodiment is shown in FIGS. 2*a* to 2*d*. Each of the figures schematically shows a detail of a piezo bending transducer drop-on-demand print head. Provided in a nozzle plate 1 there are three nozzles 11 in series, extending perpendicularly to the plane of the plate. Parallel to the nozzle plate 1, three piezo bending transducers 2 are arranged in a series parallel next to one another in such a way that their non-restrained ends 21 are respectively opposite one of the nozzles 11. Each of the piezo bending transducers 2 can be bent about a bending axis extending parallel to the nozzle plate 1 and perpendicularly to the nozzles 11.

The position of the three piezo bending transducers 2 in different stages of the sequence of movements, which takes place by the middle of the three piezo bending transducers 2 being subjected to a triggering pulse, can be seen from each of the FIGS. 2*a* to 2*e*.

Figure 2A:
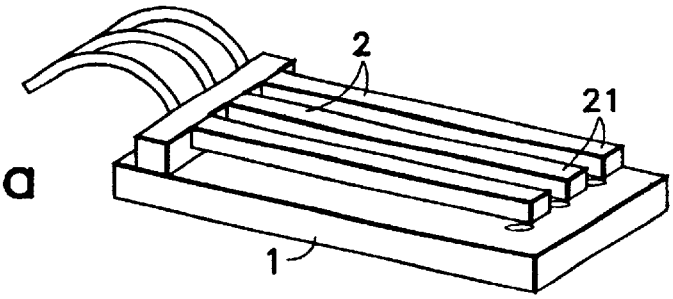
FIGS. 2*a* to 2*d* schematically show in an alternative embodiment the mode of operation of a piezo bending transducer drop-on-demand print head actuated by the method of the invention and of a piezo bending transducer drop-on-demand print head according to the invention operating in accordance with this method, respectively.

In FIG. 2*a*, all three piezo bending transducers 2 are in the position of rest.

Figure 2B:
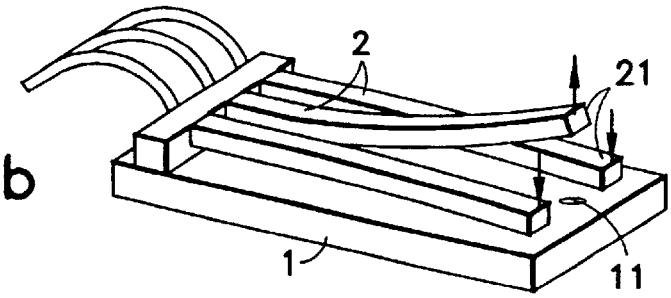

In FIG. 2*b*, the middle piezo bending transducer 2 is in the deflecting movement, as a result of the application of the triggering pulse, so that its free end 21 is being moved away from the assigned nozzle 11 (cf. arrow). At the same time, the two outer piezo bending transducers 2 are being subjected to the closing control pulse and are consequently deflected, so that their free ends 21 are moved toward the respectively assigned nozzles 11 (cf. arrows). In this case, the two outer piezo bending transducers 2 are moved so far toward the nozzles 11 assigned to them that the nozzles 11 are fully or partly flow-controlled mechanically from the printer chamber filled with printing fluid.

Figure 2C:
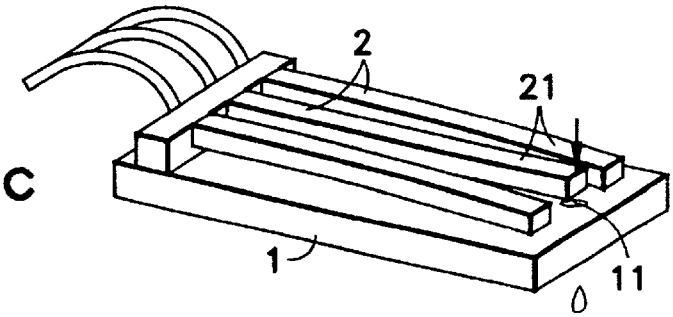

In FIG. 2*c*, the triggering pulse has terminated, the deflecting voltage is no longer acting, and the middle piezo bending transducer 2 is racing back as a result of the mechanical stresses built up in the structure during deflecting, so that the free end 21 is being moved toward the assigned nozzle 11 (cf. arrow). As a result, the discharge of a drop is effected at the nozzle 11 assigned to the middle piezo bending transducer 2. The two outer piezo bending transducers 2 continue to be subjected to the closing control pulse. Their free ends 32 consequently continue to be kept in a position close to the respectively assigned nozzles 11. In this case, the nozzles 11 assigned to the two outer piezo bending transducers 2 continue to be fully or partly screened flow-mechanically from the printer chamber filled with printing fluid. As a consequence, although the rapid return of the middle piezo bending transducer 2 can lead to a flow movement in the region of the nozzles 11 assigned to the outer piezo bending transducers 2, no drop exits at these nozzles 11 as a result of the flow-mechanical control.

Figure 2D:
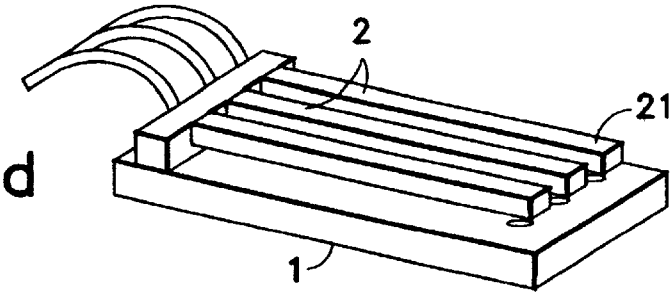

In FIG. 2*d*, the middle piezo bending transducer 2 has raced back fully into its starting position as a result of the mechanical stresses built up in the structure during deflecting. The two outer piezo bending transducers 2 no longer continue to be subjected to the closing control pulse and have consequently likewise raced back fully into their starting positions as a result of the mechanical stresses built up in the structure during deflecting.

Figure 3:
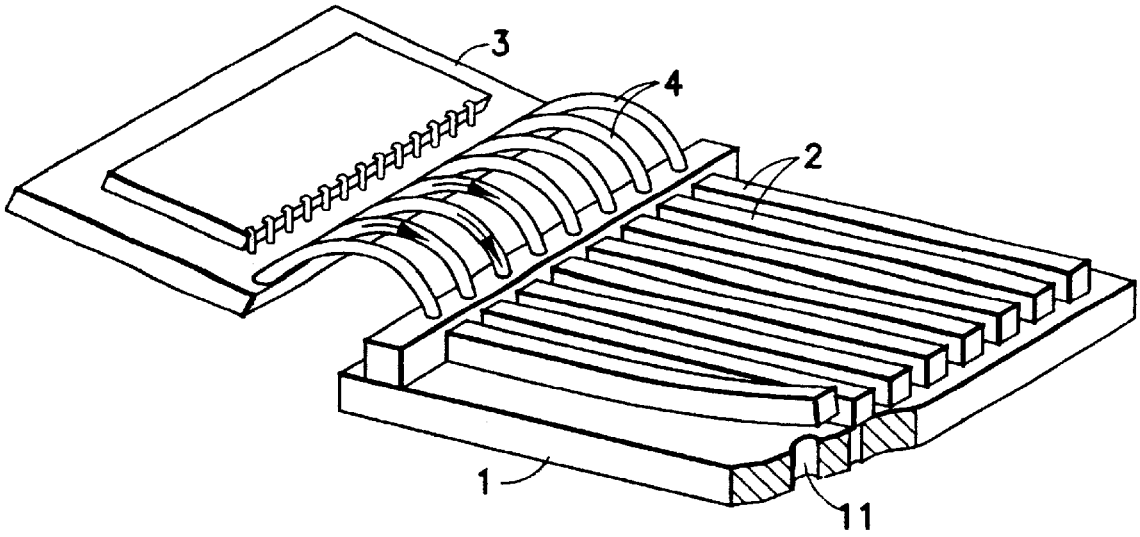
FIG. 3 schematically shows the construction of a piezo bending transducer drop-on-demand print head according to the invention.

The construction of a piezo bending transducer drop-on-demand print head according to the invention can be seen schematically from FIG. 3. As far as the nozzle plate 1 and the piezo bending transducers 2 are concerned, the construction corresponds to the representation according to FIGS. 1*a* to 1*e*, although more nozzles 11 and piezo bending transducers 2 are represented. Each of the piezo bending transducers 2 is connected via a signal line 4 to a control device 3. The control device 3 is designed in such a way that, in a way corresponding to the method according to the invention, with each triggering pulse, compensating pulses are emitted after a time delay to the piezo bending transducers 2 neighboring the triggered piezo bending transducer 2. This is indicated by the arrows along the signal lines 4. The control device 3 is designed as an integrated circuit.

Different types of piezo bending transducers, which are provided in different embodiments of the piezo bending transducer drop-on-demand print head according to the invention, can be seen from FIGS. 4*a* to 4*d*, 5*a* and 5*b* as well as 6. All the piezo bending transducers 2 represented are in each case represented in side view with the restrained ends on the left-hand side. The axis about which the piezo bending transducer 2 is bent extends in each case perpendicularly to the plane of the drawing.

Figure 4A:
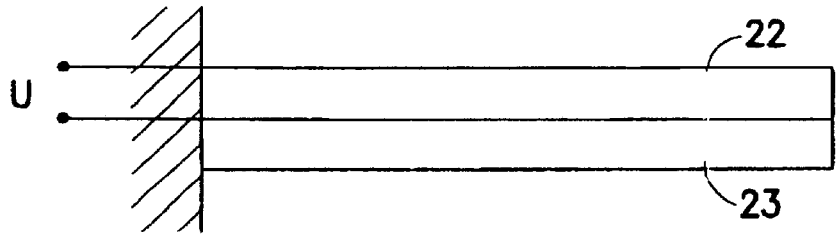
FIGS. 4*a* to 4*d* schematically show the construction of piezo bending transducers with different layer arrangements according to different embodiments of the piezo bending transducer drop-on-demand print head according to the invention.

A piezo bimorph with a passive layer can be seen from FIG. 4*a*. The piezo bending transducer 2 comprises two layers of piezoceramic, one active layer 22 and one passive layer 23. A voltage is applied only to the active layer 22, so that its length is changed. Since the length of the passive layer 23 remains constant, a bending of the piezo bending transducer 2 occurs.

Figure 4B:
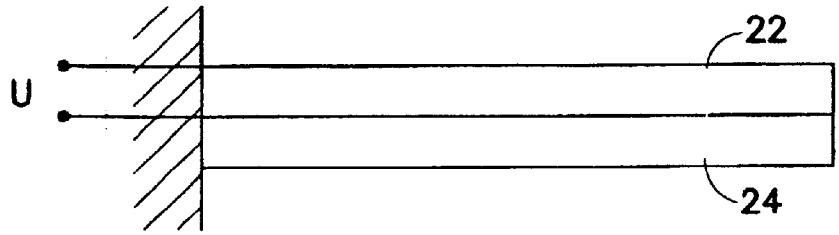

A piezo monomorph, in which the passive layer 23 is substituted by a layer 24 not consisting of piezoceramic, can be seen from FIG. 4*b*.

Figure 4C:
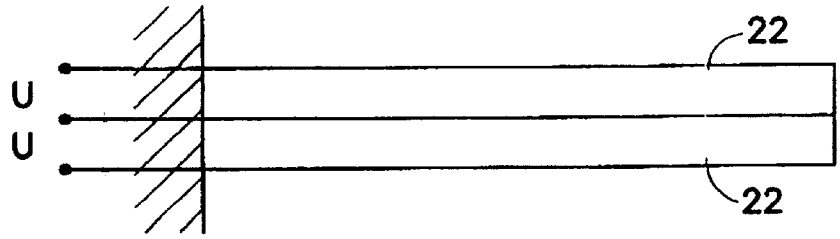

A piezo bimorph, in which there are two active layers 22, can be seen from FIG. 4*c*. These layers are oppositely polarized and are subjected to oppositely polarized voltage, so that the one layer is shortened and the other layer is lengthened.

Figure 4D:
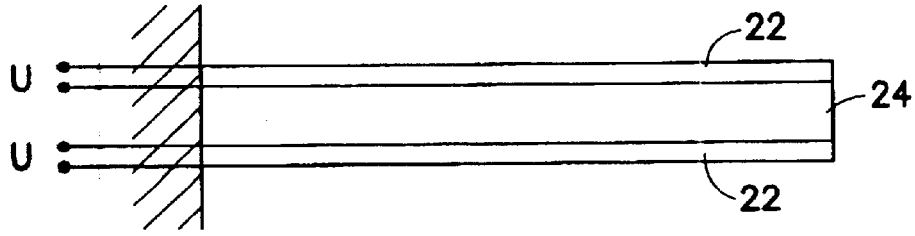

A piezo trimorph, in which there are two active layers 22, between which a layer 24 not consisting of piezoceramic is arranged, can be seen from FIG. 4*d*. Such a construction permits greater deflections with the same voltage.

Figure 5A:
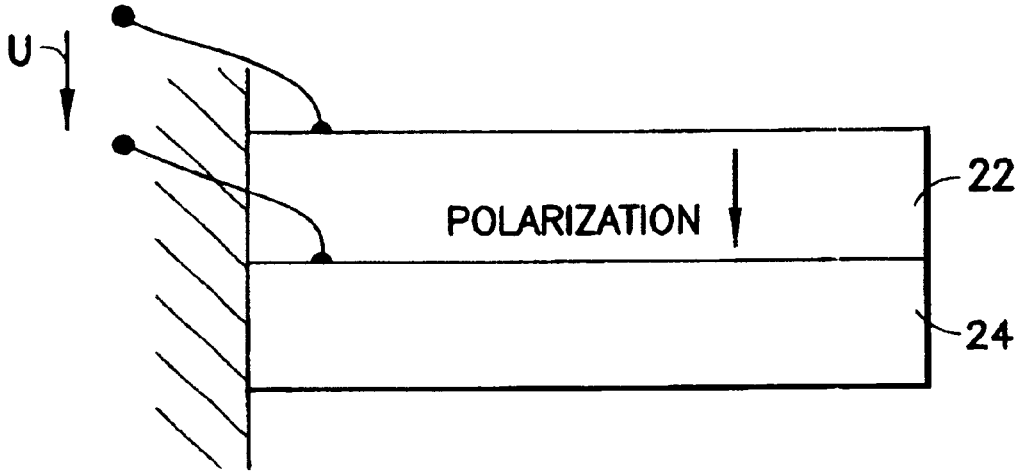
FIGS. 5*a* and 5*b* schematically show the construction of piezo bending transducers with different contacting arrangements according to different embodiments of the piezo bending transducer drop-on-demand print head according to the invention.

A construction in which the transverse effect of the piezoceramic is utilized can be seen from FIG. 5*a*. The polarization of the piezoceramic extends in a direction perpendicular to the layers. A positive voltage applied along this polarization effects an expansion of the material in the direction of polarization. Due to the mechanical transverse contraction, a contraction simultaneously occurs in the longitudinal direction of the piezo bending transducer 2, which leads to bending because of the rigid other layer.

Figure 5B:
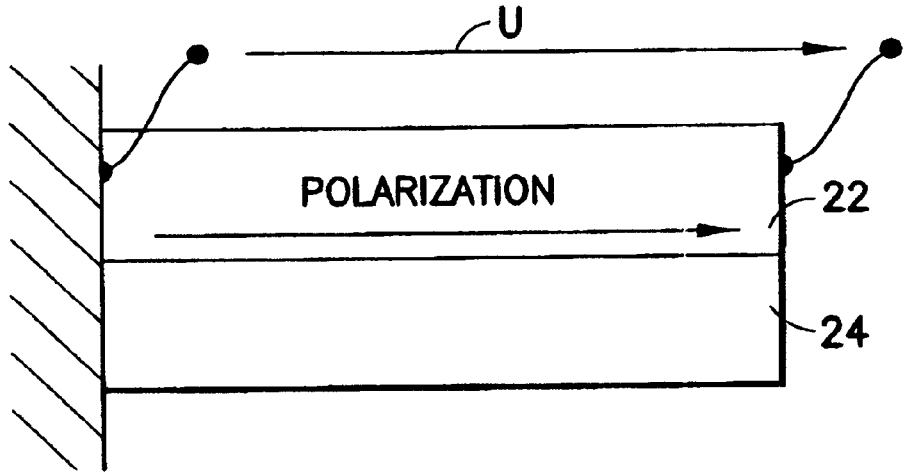

A construction in which the longitudinal effect of the piezoceramic is utilized can be seen from FIG. 5*b*. The polarization of the piezoceramic extends in the longitudinal direction of the piezo bending transducer 2. A positive voltage applied along this polarization effects an expansion of the material in the direction of polarization. A bending of the piezo bending transducer 2 occurs because of the rigid other layer.

Figure 6:
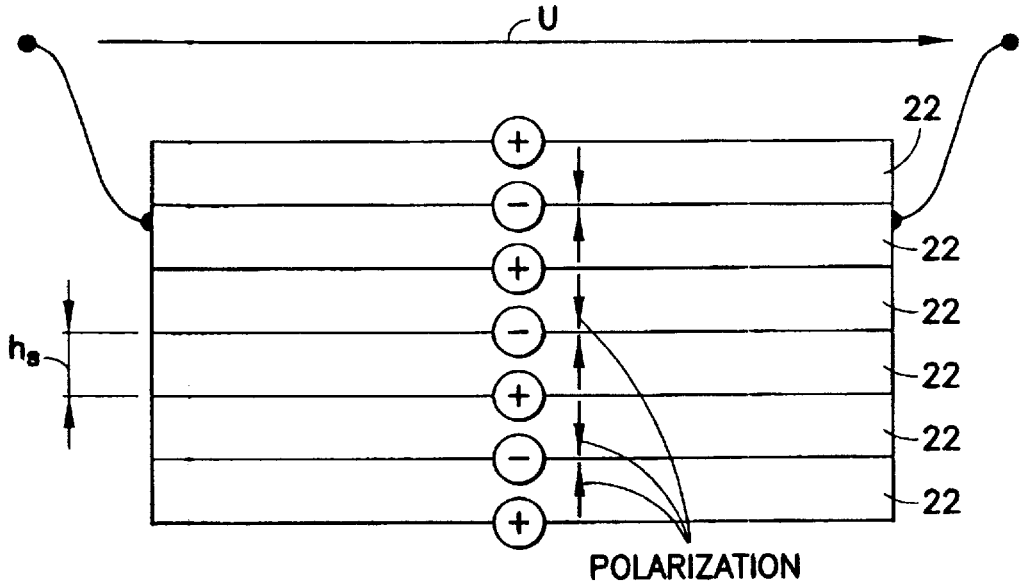
FIG. 6 schematically shows the construction of a piezo bending transducer with a multi-layer arrangement according to one embodiment of the piezo bending transducer drop-on-demand print head according to the invention.

A multi-layer construction of a piezoceramic layer can be seen from FIG. 6. Instead of a layer which is uniformly polarized and provided with contacts at two opposite ends, a plurality of layers which are respectively provided alternately with opposite polarization are provided. Provided between the layers are contacts alternately connected to the positive and negative poles. In this way, a great longitudinal effect of the piezoceramic is achieved with a short overall size.

According to the invention, each of the types of design which can be seen from FIGS. 4*a* to 4*d*, with a longitudinal effect according to FIG. 5*a*, if appropriate a multi-layer construction according to FIG. 6, or with a transverse effect according to FIG. 5*b*, may be used for the piezo bending transducers of the piezo bending transducer drop-on-demand print head.

Figure 7:
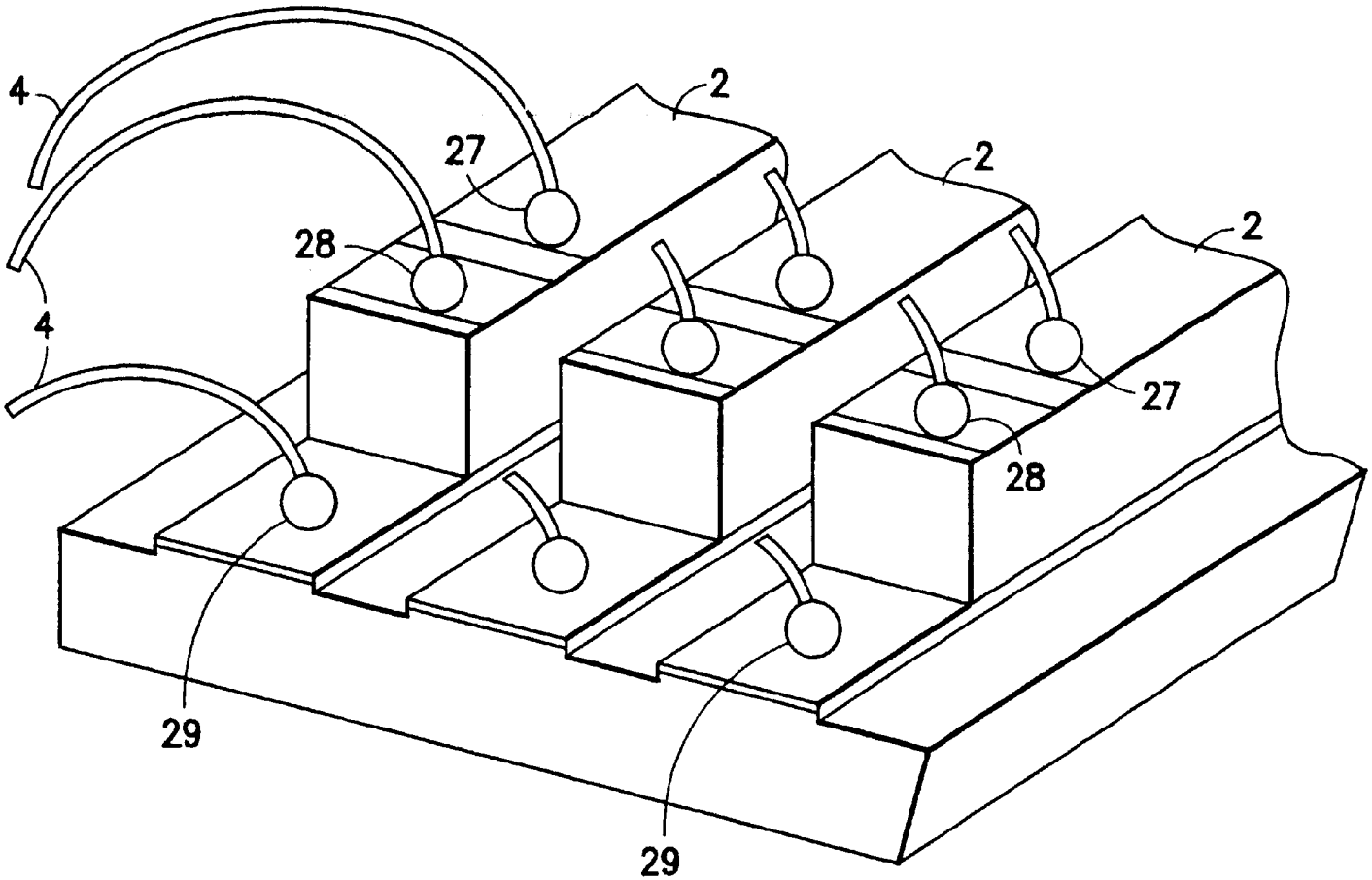
FIG. 7 shows in a perspective representation three piezo bending transducers constructed as a bimorph, with three-pole contacting.
Figure 8:
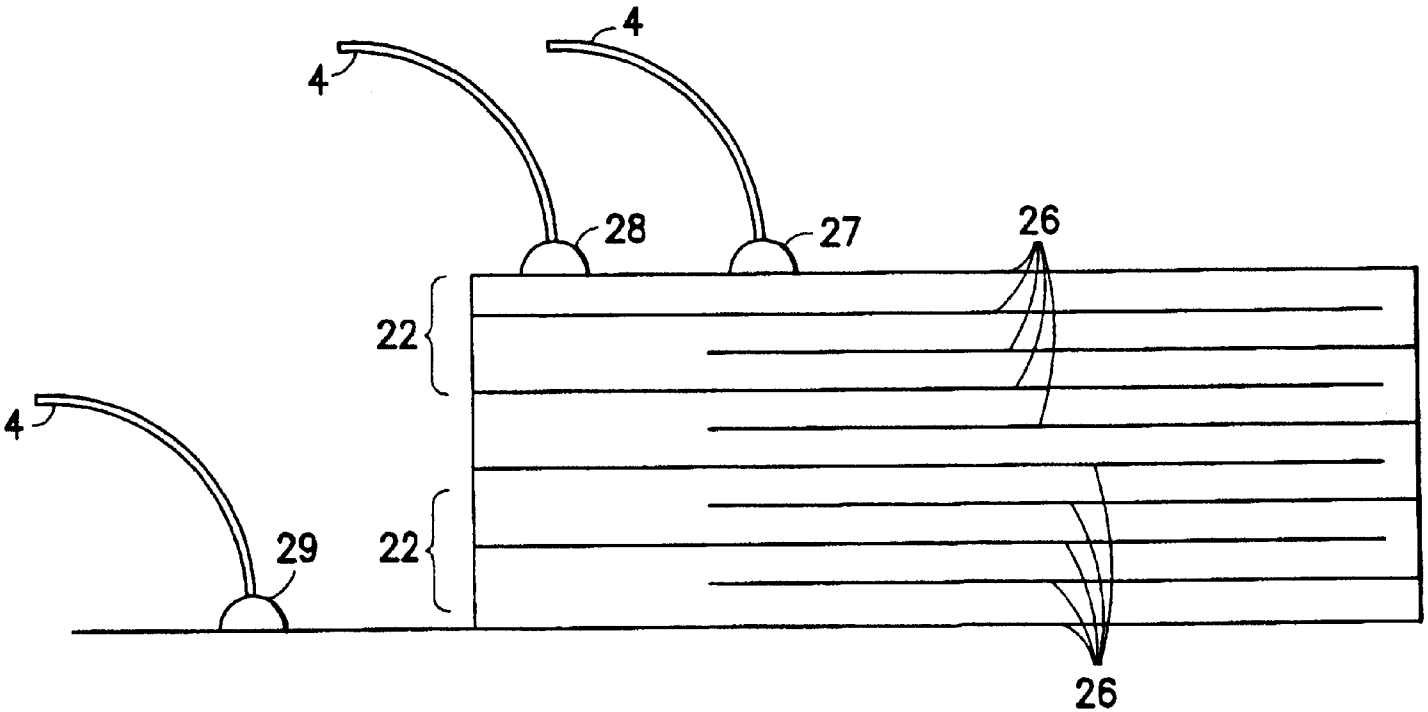
FIG. 8 schematically shows in cross section a piezo bending transducer constructed as a bimorph, with three-pole contacting.

FIGS. 7 and 8 illustrate how the three-pole contacting of a piezo bending transducer 2 constructed as a bimorph is designed. A bimorph piezo bending transducer 2 with three-pole contacting, which is designed as a multi-layer piezo bending transducer, is shown in cross section in FIG. 8. The piezo bending transducer 2 has an upper and a lower active layer 22.

The bimorph piezo bending transducer 2 is constructed from layers of piezoceramic over its entire thickness. Neighboring layers are respectively provided with opposite polarization. Contact foils 26 are respectively arranged between the layers. Every second one of the contact foils 26 is connected to a mass contact bridge at the one end of the piezo bending transducer 2. The mass contact bridge is connected to the mass contact 27, which is arranged on the upper side of the piezo bending transducer 2, at a distance from the other end of the piezo bending transducer 2. The mass contact 27 is connected via a signal line 4 to the control device 3 (not shown here). The remaining contact foils 26 are assigned to the two active layers 22. In the region of the upper active layer 22, contact foils 26 are connected to a contact bridge which extends at the other end of the piezo bending transducer 2 and is connected to a first signal contact 28, which is arranged on the upper side of the piezo bending transducer 2, close to the other end of the piezo bending transducer 2. The first signal contact 27 is connected via a signal line 4 to the control device 3 (not shown here). In the region of the lower active layer 22, the contact foils 26 are connected to a further contact bridge, which extends at the other end of the piezo bending transducer 2 and is connected to a second signal contact 29, which is arranged on the underside of the piezo bending transducer 2, close to the other end of the piezo bending transducer 2. The second signal contact 29 is connected via a signal line 4 to the control device 3 (not shown here).

The spatial arrangement of mass contact 27, first signal contact 28 and second signal contact 29 can be seen in a perspective representation in FIG. 7. As illustrated, the mass contact 27 and the first signal contact 28 are both arranged on the upper side of the piezo bending transducer 2 and are insulated from each other.

Figure 9:
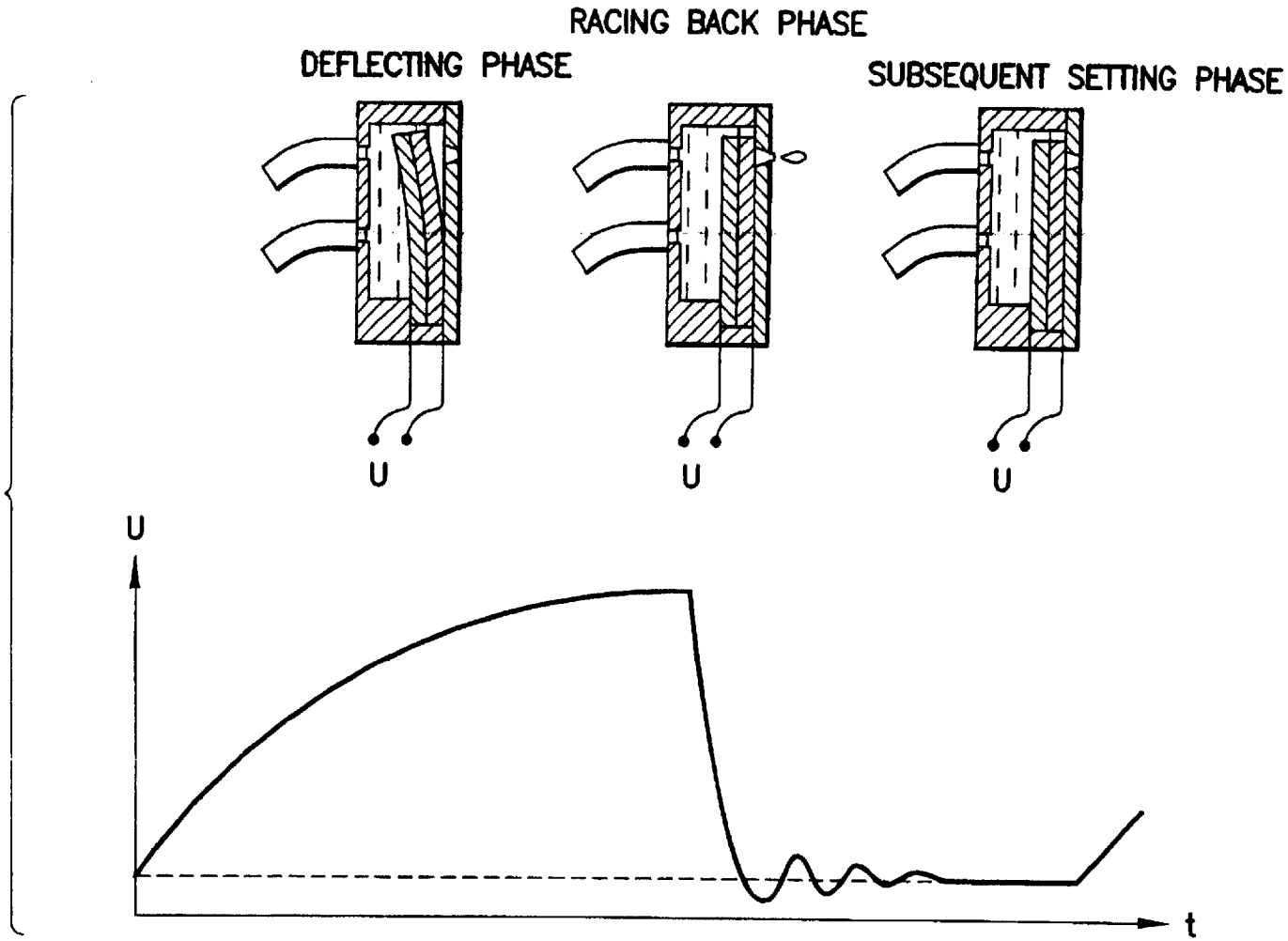
FIG. 9 schematically shows the mode of operation of a piezo bending transducer during the discharge of a drop, together with the associated characteristic of the voltage applied to the piezo bending transducer.

The time characteristic of the voltage applied directly to the piezoceramic during the deflecting phase, during the phase of the piezo bending transducer racing back and during the subsequent settling phase of the piezo bending transducer is shown for a triggering pulse in FIG. 9.

Figure 10A:
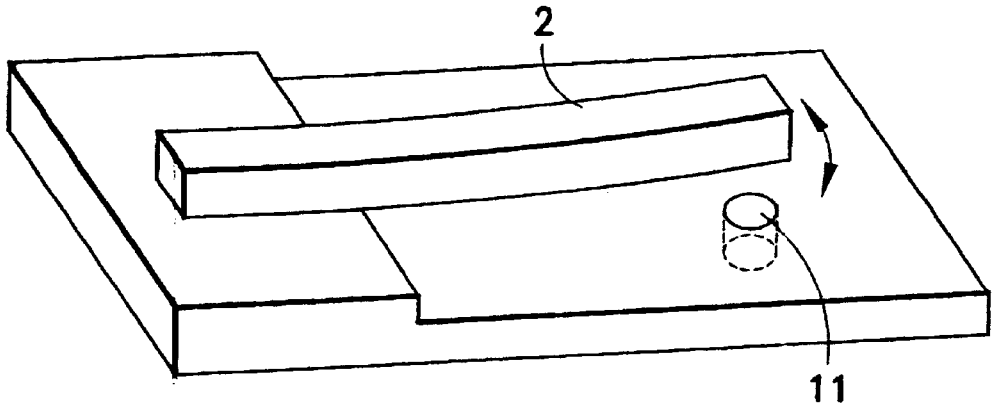
FIGS. 10A and 10B schematically show the construction and arrangement of a piezo reed transducer and a piezo bridge transducer, respectively.

The construction and arrangement of a piezo reed transducer used according to the invention is shown schematically in FIG. 10A.

Figure 10B:
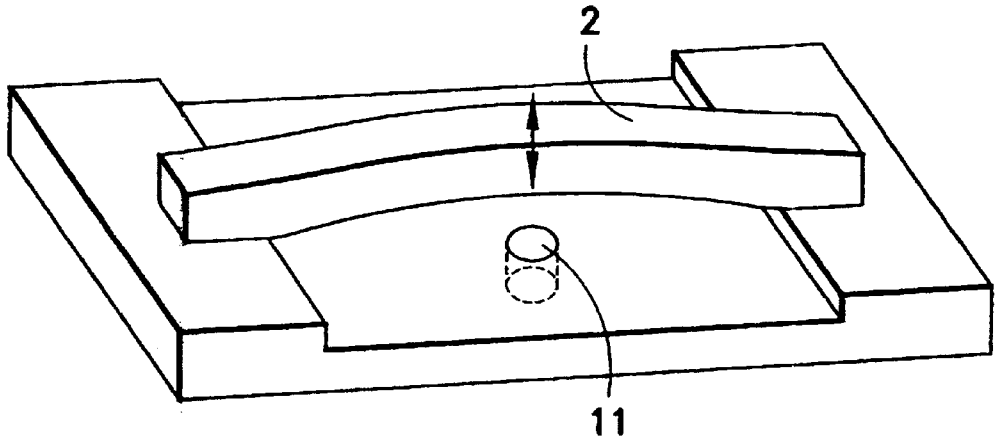

The construction and arrangement of a piezo bridge transducer used according to the invention is shown schematically in FIG. 10B.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A method of actuating a piezo bending transducer drop-on-demand print head, the print head having a nozzle plate with a plurality of nozzles arranged in series, wherein each of a series of piezo bending transducers is respectively assigned to each of said plurality of nozzles, comprising: subjecting each of the piezo bending transducers to a sequence, corresponding to the desired print image, of triggering pulses each effecting a drop discharge movement; and, assigned to each triggering pulse, each piezo bending transducer neighboring piezo bending transducer triggered by the triggering pulse being subjected to a compensating pulse deflecting it wherein the triggering pulse has an amplitude and each of the neighboring piezo bending transducers is subjected to a compensating pulse of a lower amplitude than said triggering pulse amplitude.

2. The method of claim 1 wherein the amplitude of the compensating pulse is lower than the amplitude of the triggering pulse by two thirds.

3. The method of claim 1 wherein the triggering pulse has a duration and each of the neighboring piezo bending transducers is subjected to a compensating pulse of a shorter duration than the duration of the triggering pulse.

4. The method of claim 1 wherein each of the neighboring piezo bending transducers is subjected to the compensating pulse with a time delay, preferably a delay of 80 microseconds, after the assigned triggering pulse.

5. The method of claim 1 wherein each of the neighboring piezo bending transducers is subjected to a compensating pulse by which the neighboring piezo bending transducer is initially deflected in an opposite direction from that of the triggered piezo bending transducer.

6. The method of claim 1 wherein there are neighboring two triggered piezo bending transducers, the piezo bending transducers neighboring the triggered piezo bending transducers are subjected to a compensating pulse of a larger amplitude than when said neighboring transducers are neighboring only one triggered piezo bending transducer.

7. The method of claim 6 wherein the piezo bending transducers are subjected to triggering pulses in a single group and the triggered piezo bending transducers are subjected to different triggering pulses, depending on whether both, one or none of the neighboring piezo bending transducers is/are likewise triggered.

8. The method of claim 7 wherein the piezo bending transducers are subjected to a triggering pulse of lower amplitude when one of the respectively neighboring piezo bending transducers is likewise triggered than if none of the respectively neighboring piezo bending transducers is likewise triggered, and are subjected to a triggering pulse of still lower amplitude if both the respectively neighboring piezo bending transducers are likewise triggered.

9. The method of claim 1 wherein the piezo bending transducers are subjected to triggering pulses in two groups at staggered time intervals, mutually neighboring piezo bending transducers respectively belonging to different groups.

10. The method of claim 1 wherein the neighboring piezo bending transducers are subjected to compensating pulses with a gradually falling edge.

11. The method of claim 1 further comprising a pre-operation trimming process.

12. The method of claim 11 wherein the trimming process comprises: determining at least one of the amplitude, duration and/or time delay of compensating pulses or closing control pulses for each of the piezo bending transducers by varying the respectively applied compensating pulses or closing control pulses with respect to the respective amplitude, duration and/or time delay for intended setups of triggering pulses, measuring the drop discharge and crosstalk behavior in response to said variation; and adjusting at least one of said amplitude, duration and/or time delay based on said measuring.

13. The method of claim 12 wherein only the duration and/or time delay of compensating pulses or closing control pulses are varied in the trimming process.

14. The method of claim 12 wherein the piezo bending transducer is used as a sensor in the trimming process, in that voltages which result from the triggering of a piezo bending transducer, the fluid movement brought about as a result and the deflecting of the neighboring piezo bending transducers cause to be induced in the latter are measured and evaluated for optimizing the drop discharge or crosstalk behavior.

15. The method of claim 12 wherein the piezo bending transducers neighboring the triggered piezo bending transducers being subjected during operation in progress to compensating pulses or closing control pulses for which the amplitude, duration and/or time delay are determined, in that voltages which result from the triggering of a piezo bending transducer, the fluid movement brought about as a result and the deflecting of the neighboring piezo bending transducers cause to be induced in the latter are measured and processed.

16. A method of actuating a piezo bending transducer drop-on-demand print head, the print head having a nozzle plate with a plurality of nozzles arranged in series, respectively assigned to which there is a piezo bending transducer of a series of piezo bending transducers wherein each of the piezo bending transducers is subjected to a sequence, corresponding to the desired print image, of triggering pulses each effecting a drop discharge movement and, assigned to each triggering pulse, each piezo bending transducer neighboring the piezo bending transducer triggered subjected to said pulse is subjected to a closing control pulse, by which the neighboring piezo bending transducer is deflected toward the nozzle assigned to it and is held there for a period wherein the triggering pulse has an amplitude and the neighboring piezo bending transducers are subjected to a closing control pulse of an amplitude which is no more than about one sixth of the amplitude of the triggering pulse.

17. A piezo bending transducer drop-on-demand print head, comprising:

a nozzle plate with a plurality of nozzles arranged in series;

a plurality of piezo bending transducers respectively assigned to each of said plurality of nozzles, wherein one or more of said transducers can be subjected to a triggering pulse accompanied by a drop being discharged from the respective nozzle pursuant to a sequence to form a desired print image;

a control device for subjecting each of the piezo bending transducers to a triggering pulse to effect a drop discharge movement and subjecting each piezo bending transducer neighboring each triggered piezo bending transducer to a compensating pulse; said triggering pulse having an amplitude and said compensating pulse having an amplitude lower by two thirds.

18. The piezo bending transducer drop-on-demand print head of claim 17, which has at least three-pole piezo bending transducers, each with two active layers made of piezoceramic, and a control device, by which the triggering pulses are applied to one active layer and the closing control pulses are applied to the other active layer of the piezo bending transducer.

19. The piezo bending transducer drop-on-demand print head of claim 17 wherein the piezo bending transducers are piezo reed transducers and/or piezo bridge transducers.

20. A piezo bending transducer drop-on-demand print head, comprising a nozzle plate with a plurality of nozzles arranged in series;

a plurality of piezo bending transducers wherein each of said plurality of said transducers is respectively assigned to each of said plurality of nozzles, said transducer being subjected to a triggering pulse accompanied by a drop being discharged from the respective nozzle, and a control device by which each of the plurality of piezo bending transducers is subjected to a triggering pulse having an amplitude and each transducer neighboring said triggered transducer is subjected to a closing control pulse having an amplitude, said control pulse amplitude being no more than one sixth of the triggering pulse amplitude.

21. The piezo bending transducer drop-on-demand print head of claim 20, which has at least three-pole piezo bending transducers, each with two active layers made of piezoceramic, and a control device, by which the triggering pulses are applied to one active layer and the closing control pulses are applied to the other active layer of the piezo bending transducer.

22. The piezo bending transducer drop-on-demand print head of claim 20 wherein the piezo bending transducers are piezo bridge transducers and/or piezo reed transducers.

23. A method of actuating a piezo bending transducer drop-on-demand print head, the print head having a nozzle plate with a plurality of nozzles arranged in series, wherein each of a series of piezo bending transducers is respectively assigned to each of said plurality of nozzles, comprising: subjecting each of the piezo bending transducers to a sequence, corresponding to the desired print image, of triggering pulses each effecting a drop discharge movement; and, assigned to each triggering pulse, each piezo bending transducer neighboring the piezo bending transducer triggered by the triggering pulse being subjected to a compensating pulse deflecting it wherein each of the neighboring piezo bending transducers is subjected to a compensating pulse by which the neighboring piezo bending transducer is initially deflected in an opposite direction from that of the triggered piezo bending transducer.

24. The method of claim 23 wherein the triggering pulse has an amplitude and each of the neighboring piezo bending transducers is subjected to a compensating pulse of a lower amplitude than said triggering pulse amplitude, preferably an amplitude lower by two thirds.

25. The method of claim 23 wherein the triggering pulse has a duration and each of the neighboring piezo bending transducers is subjected to a compensating pulse of a shorter duration than the duration of the triggering pulse.

26. The method of claim 23 wherein each of the neighboring piezo bending transducers is subjected to the compensating pulse with a time delay, preferably a delay of 80 microseconds, after the assigned triggering pulse.

27. The method of claim 23 wherein there are neighboring two triggered piezo bending transducers, the piezo bending transducers neighboring the triggered piezo bending transducers are subjected to a compensating pulse of a larger amplitude than when said neighboring transducers are neighboring only one triggered piezo bending transducer.

28. The method of claim 27 wherein the piezo bending transducers are subjected to triggering pulses in a single group and the triggered piezo bending transducers are subjected to different triggering pulses, depending on whether both, one or none of the neighboring piezo bending transducers is/are likewise triggered.

29. The method of claim 28 wherein the piezo bending transducers are subjected to a triggering pulse of lower amplitude when one of the respectively neighboring piezo bending transducers is likewise triggered than if none of the respectively neighboring piezo bending transducers is likewise triggered, and are subjected to a triggering pulse of still lower amplitude if both the respectively neighboring piezo bending transducers are likewise triggered.

30. The method of claim 25 wherein the piezo bending transducers are subjected to triggering pulses in two groups at staggered time intervals, mutually neighboring piezo bending transducers respectively belonging to different groups.

31. The method of claim 23 wherein the neighboring piezo bending transducers are subjected to compensating pulses with a gradually falling edge.

32. The method of claim 23 further comprising a pre-operation trimming process.

33. The method of claim 32 wherein the trimming process comprises: determining at least one of the amplitude, duration and/or time delay of compensating pulses or closing control pulses for each of the piezo bending transducers by varying the respectively applied compensating pulses or closing control pulses with respect to the respective amplitude, duration and/or time delay for intended setups of triggering pulses, measuring the drop discharge and crosstalk behavior in response to said variation; and adjusting at least one of said amplitude, duration and/or time delay based on said measuring.

34. The method of claim 33 wherein only the duration and/or time delay of compensating pulses or closing control pulses are varied in the trimming process.

35. The method of claim 33 wherein the piezo bending transducer is used as a sensor in the trimming process, in that voltages which result from the triggering of a piezo bending transducer, the fluid movement brought about as a result and the deflecting of the neighboring piezo bending transducers cause to be induced in the latter are measured and evaluated for optimizing the drop discharge or crosstalk behavior.

36. The method of claim 33 wherein the piezo bending transducers neighboring the triggered piezo bending transducers being subjected during operation in progress to compensating pulses or closing control pulses for which the amplitude, duration and/or time delay are determined, in that voltages which result from the triggering of a piezo bending transducer, the fluid movement brought about as a result and the deflecting of the neighboring piezo bending transducers cause to be induced in the latter are measured and processed.

37. A piezo bending transducer drop-on-demand print head, comprising:

a nozzle plate with a plurality of nozzles arranged in series;

a plurality of piezo bending transducer respectively assigned to each of said plurality of nozzles, wherein one or more of said transducers can be subjected to a triggering pulse accompanied by a drop being discharged from the respective nozzle pursuant to a sequence to form a desired print image;

a control device for subjecting each of the piezo bending transducers to a triggering pulse to effect a drop discharge movement and subjecting each piezo bending transducer neighboring each triggered piezo bending transducer to a compensating pulse wherein each of the neighboring piezo bending transducers is subjected to a compensating pulse by which the neighboring piezo bending transducer is initially deflected in an opposite direction from that of the triggered piezo bending transducer.

38. The piezo bending transducer drop-on-demand print head of claim 37, which has at least three-pole piezo bending transducers, each with two active layers made of piezoceramic, and a control device, by which the triggering pulses are applied to one active layer and the closing control pulses are applied to the other active layer of the piezo bending transducer.

39. The piezo bending transducer drop-on-demand print head of claim 37 wherein the piezo bending transducers are piezo reed transducers and/or piezo bridge transducers.

40. A piezo bending transducer drop-on-demand print head, comprising a nozzle plate with a plurality of nozzles arranged in series;

a plurality of piezo bending transducers wherein each of said plurality of said transducers is respectively assigned to each of said plurality of nozzles, said transducer being subjected to a triggering pulse accompanied by a drop being discharged from the respective nozzle, and a control device by which each of the plurality of piezo bending transducers is subjected to a triggering pulse and each transducer neighboring said triggered transducer is subjected to a closing control pulse wherein the triggering pulse has an amplitude and the neighboring piezo bending transducers are subjected to a closing control pulse of an amplitude which is no more than about one sixth of the amplitude of the triggering pulse.

41. The piezo bending transducer drop-on-demand print head of claim 40, which has at least three-pole piezo bending transducers, each with two active layers made of piezoceramic, and a control device, by which the triggering pulses are applied to one active layer and the closing control pulses are applied to the other active layer of the piezo bending transducer.

42. The piezo bending transducer drop-on-demand print head of claim 40 wherein the piezo bending transducers being are piezo bridge transducers and/or piezo reed transducers.

* * * * *